US006263854B1

(12) United States Patent
Bock

(10) Patent No.: US 6,263,854 B1
(45) Date of Patent: Jul. 24, 2001

(54) CYLINDER HEAD FOR AN INTERNAL COMBUSTION ENGINE

(75) Inventor: Allyn P. Bock, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/359,244

(22) Filed: Jul. 22, 1999

(51) Int. Cl.[7] ..... F02F 1/00
(52) U.S. Cl. ..... 123/193.5
(58) Field of Search ..... 123/193.5, 302, 123/432

(56) References Cited

U.S. PATENT DOCUMENTS

| | | | | |
|---|---|---|---|---|
| 3,395,690 | | 8/1968 | Riley . | |
| 3,824,971 | | 7/1974 | Skatsche et al. . | |
| 4,285,310 | * | 8/1981 | Takizawa et al. | 123/432 |
| 4,593,662 | * | 6/1986 | Baring et al. | 123/432 |
| 4,627,396 | * | 12/1986 | Yoshida | 123/302 |
| 4,702,207 | * | 10/1987 | Hatamura et al. | 123/302 |
| 5,038,732 | * | 8/1991 | Matayoshi et al. | 123/193.5 |
| 5,119,784 | * | 6/1992 | Hashimoto et al. | 123/432 |
| 5,156,124 | * | 10/1992 | Sugimoto et al. | 123/302 |
| 5,207,210 | * | 5/1993 | Yamagata et al. | 123/193.5 |
| 5,365,900 | | 11/1994 | Farnlund et al. . | |
| 6,065,437 | * | 5/2000 | Kleinschmidt | 123/193.5 |

* cited by examiner

*Primary Examiner*—Marguerite McMahon
(74) *Attorney, Agent, or Firm*—Todd T. Taylor

(57) ABSTRACT

An internal combustion engine includes a housing with at least one combustion cylinder, and a cylinder head which is attached to the housing and covers at least one combustion cylinder. The cylinder head includes at least one inlet air channel and at least one exhaust channel. Each inlet air channel and exhaust channel is associated with at least one respective combustion cylinder. Each air inlet channel includes a single inlet opening and two inlet valve seats. The inlet valve seats are positioned in a parallel fluid flow configuration with each other within the inlet air channel.

8 Claims, 3 Drawing Sheets

CYLINDER HEAD FOR AN INTERNAL COMBUSTION ENGINE

TECHNICAL FIELD

The present invention relates to internal combustion engines, and, more particularly, to cylinder heads in internal combustion engines.

BACKGROUND ART

A multi-cylinder internal combustion engine typically includes a plurality of cylinder heads which are attached to and cover corresponding combustion cylinders. Each cylinder head may include an inlet air channel and an exhaust channel which are disposed in fluid communication with a corresponding combustion cylinder. The inlet air channel and the exhaust channel may include an inlet valve seat and an exhaust valve seat which are opened and closed using an inlet valve and an exhaust valve, respectively. An internal combustion engine with a plurality of larger combustion cylinders may include multiple inlet valve seats and exhaust valve seats to ensure that the combustion air and exhaust gasses are transported into and away from the combustion cylinder.

With a cylinder head having an air inlet channel with multiple inlet valve seats as described above, it is known to place the inlet valve seats in a series arrangement within the inlet air channel such that combustion air passes over a first inlet valve seat and terminates at a second inlet valve seat. A problem with this type of configuration is that most of the combustion air passes over the first inlet valve seat and flows through the second inlet valve seat disposed at the end of the inlet air channel. The combustion air is therefore not evenly introduced into the combustion cylinder through the inlet valve seats, and may not ensure that an adequate supply of combustion air is introduced into the combustion cylinder. Additionally, the push rods associated with each cylinder head typically pass through an opening defined by the cylinder head which is disposed in the inlet opening of the inlet air channel. The push rods and associated carrying structure of the cylinder head therefore impede the flow of combustion air through the inlet air channel through the combustion cylinder. Such a cylinder head is known as a "cross-flow" cylinder head.

It is also known to provide a cylinder head with multiple inlet air channels which each terminate at a respective inlet valve seat. Such a cylinder head configuration avoids the problems associated with a "cross-flow" configuration, but also adds additional structure to the cylinder head which increases the size and manufacturing costs and complexity of the cylinder head.

The present invention is directed to overcoming one or more of the problems as set forth above.

DISCLOSURE OF THE INVENTION

In one aspect of the invention, an internal combustion engine includes a housing with at least one combustion cylinder. A cylinder head is attached to the housing and covers at least one combustion cylinder. The cylinder head includes at least one inlet air channel and at least one exhaust channel. Each inlet air channel and exhaust channel is associated with at least one respective combustion cylinder. Each air inlet channel includes a single inlet opening and two inlet valve seats. The inlet valve seats are positioned in a parallel fluid flow configuration with each other within the inlet air channel.

In another aspect of the invention, combustion air is supplied to an internal combustion engine. A housing is provided having at least one combustion cylinder. At least one combustion cylinder is covered with a cylinder head. The cylinder head includes at least one inlet air channel and at least one exhaust channel. Each inlet air channel and exhaust channel are associated with at least one respective combustion cylinder. Each air inlet channel includes a single inlet opening and two inlet valve seats. The combustion air is introduced into the inlet air channel through the single inlet opening. The combustion air flows through a main flow path extending from the single inlet opening. The combustion air is split into two branching flow paths which are disposed in a parallel fluid flow configuration relative to the main flow path. The two branching flow paths respectively terminate at the two inlet valve seats. The combustion air is loaded into each respective combustion cylinder through each corresponding two inlet valve seats.

BEST MODE FOR CARRYING OUT THE INVENTION

Figure 1:
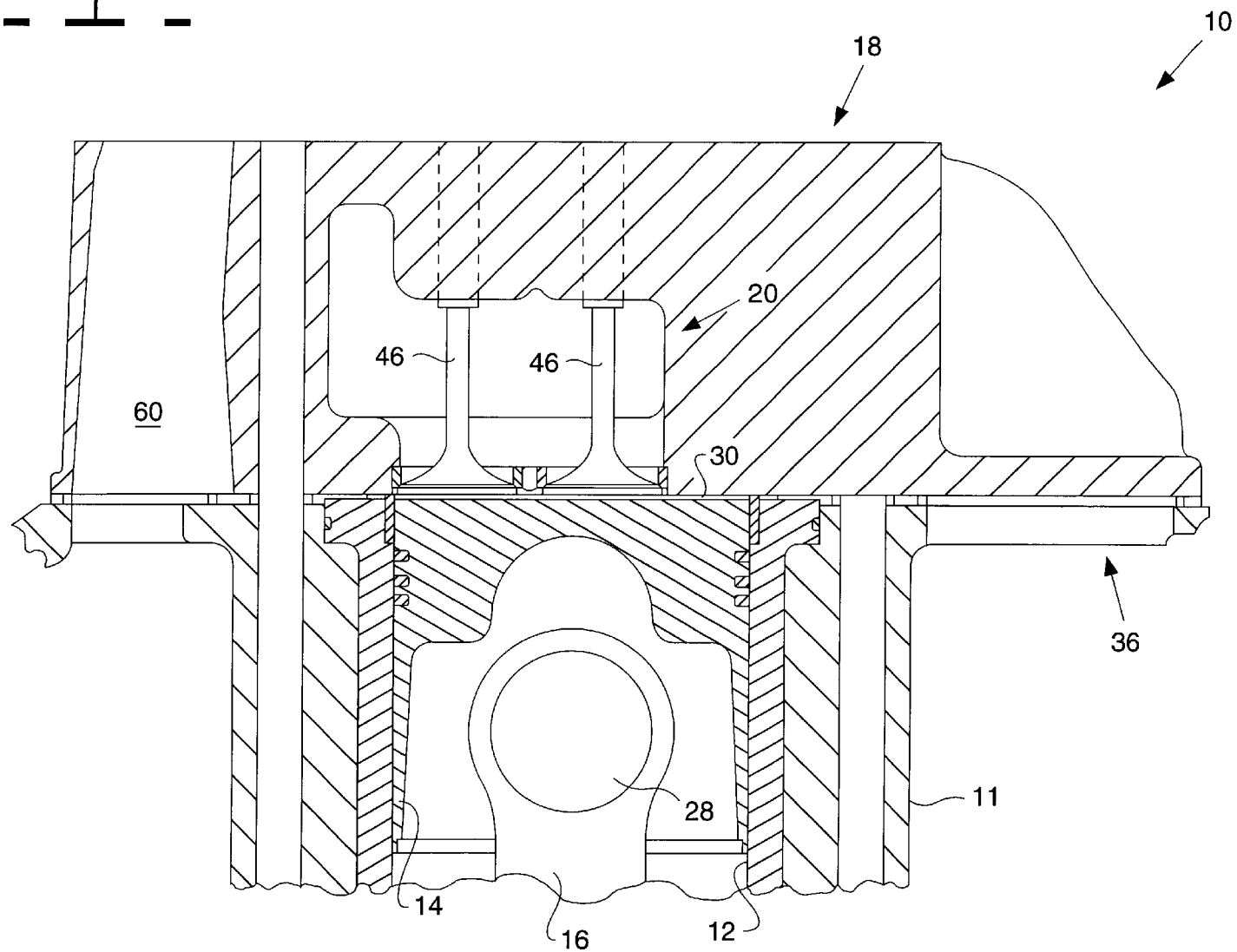
FIG. 1 is an end, sectional view of a portion of an internal combustion engine of the present invention.

Referring now to the drawings, there is shown a portion of an embodiment of an internal combustion engine 10 of the present invention. Internal combustion engine 10, in the embodiment shown, is in the form of a multi-cylinder internal combustion engine including a plurality of combustion cylinders, such as combustion cylinder 12. Associated with each combustion cylinder 12 is a piston 14, connecting rod 16 cylinder head 18, valve assembly 20 and push rods 22, 24 and 26.

Housing 11 includes the plurality of combustion cylinders, such as combustion cylinder 12. For purposes of illustration, only a single combustion cylinder 12 will be described in detail hereinafter. It is to be understood, however, that the configuration of each combustion cylinder within housing 11 is substantially the same.

Combustion cylinder 12 reciprocally carries piston 14 therein. Piston 14 is pivotally connected with connecting rod 16 via a piston pin 28. Connecting rod 16 is pivotally connected at the other end thereof with a crankshaft (not shown) carried by housing 11.

Figure 2:
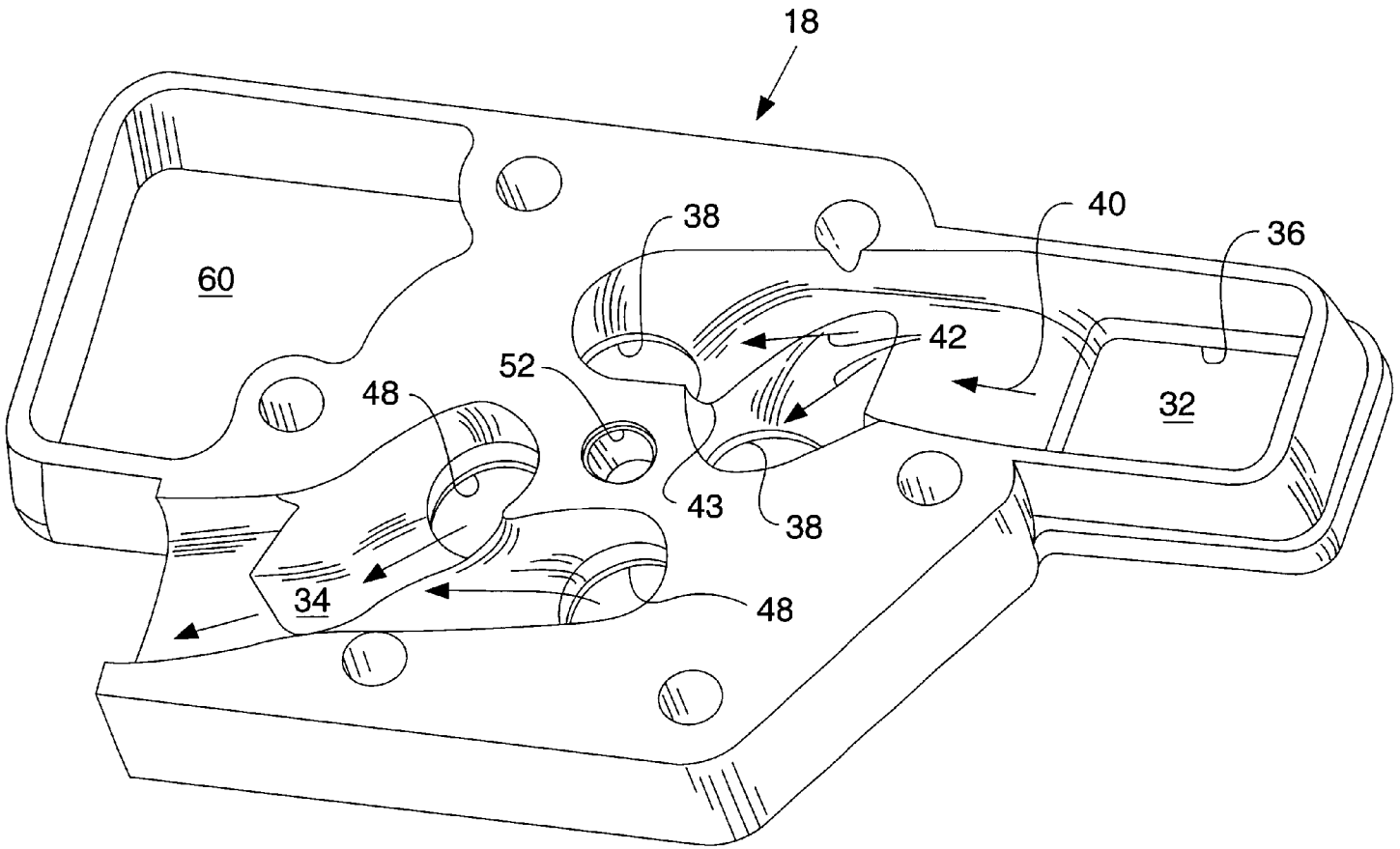
FIG. 2 is a perspective view of the cylinder head shown on both combustion cylinders in FIG. 1.
Figure 3:
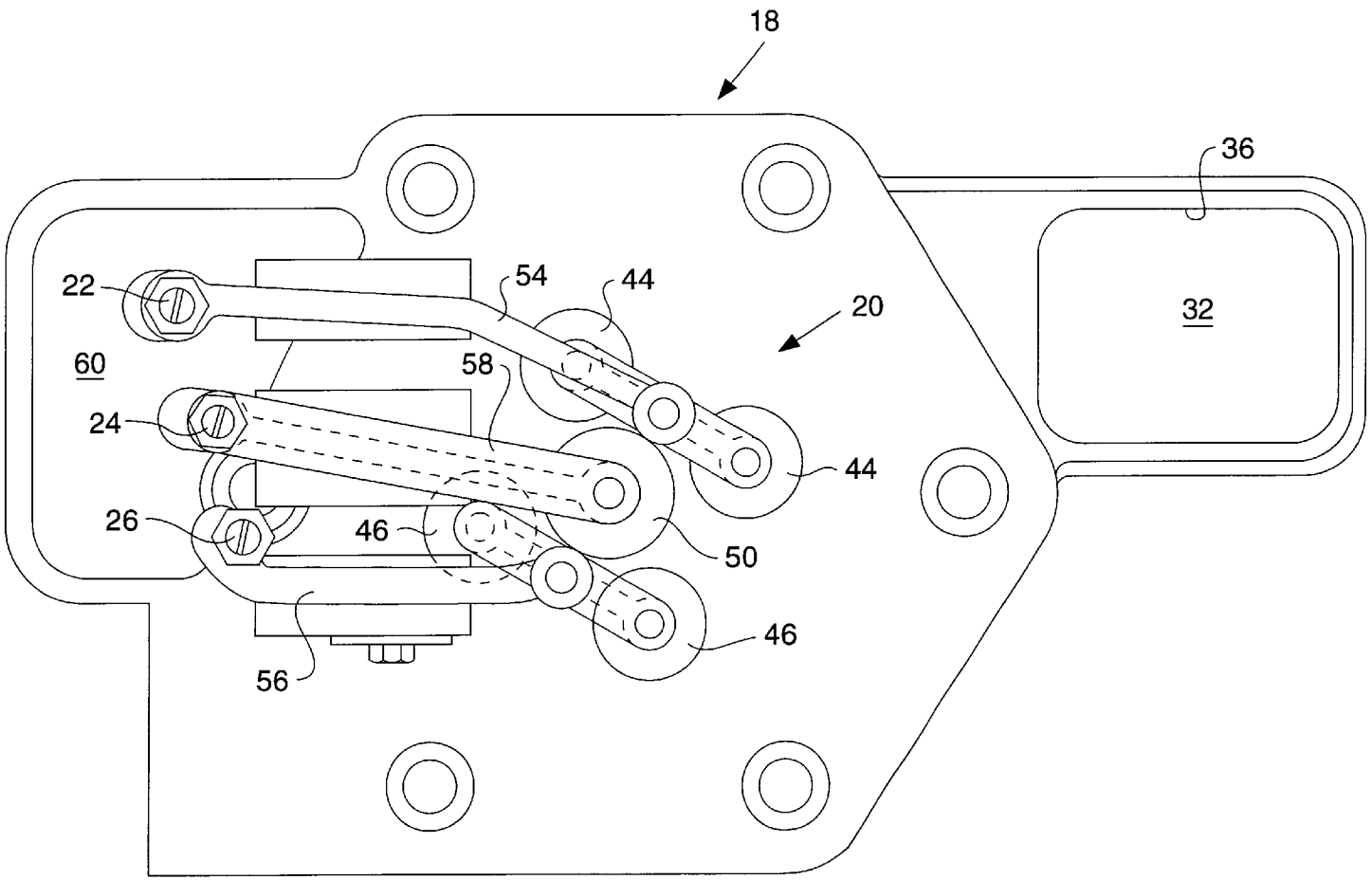
FIG. 3 is a top view of one of the cylinder heads shown in FIG. 1.

Cylinder head 18 transports combustion air into combustion chamber 30 disposed within combustion chamber 12 through inlet air channel 32. Moreover, cylinder head 18 transports exhaust gasses away from combustion chamber 30 within combustion cylinder 12 through exhaust channel 34. More particularly, inlet air channel 32 of cylinder head 18 includes a single inlet opening 36 and two inlet valve seats 38 (FIG. 2). Combustion air or an air and fuel mixture is received at inlet opening 36 and flows through a main flow path 40 extending away from inlet opening 36. The main flow path 40 of combustion air is split into two branching flow paths 42 of combustion air by the geometric configuration of inlet air channel 32, including a contoured divider wall 43. Each of the two branching flow paths 42 terminate at a respective inlet valve seat 38. Combustion air is transported through each inlet valve seat 38 into combustion chamber 30 within combustion cylinder 12.

Valve assembly 20 includes two inlet valves 44 associated with inlet valve seats 38; two exhaust valves 46 associated with exhaust valve seats 48; and a fuel injector 50 associated with fuel injector seat 52. Each valve 44 and 46 is controllably moved in an axial direction toward and way from valve seats 38 and 48 to control a flow of combustion air into and exhaust gasses out of combustion chamber 30. Inlet valves 44, exhaust valves 46 and fuel injector 50 are connected with push rods 22, 24 and 26 via rocker arms 54, 56 and 58, respectively. Push rods 22, 24 and 26 are connected with respective lever lifters (not shown) which in turn engage cams on a camshaft (not shown). Push rods 22, 24 and 26 are thereby moved in opposite axial directions to exert axial loads on rocker arms 54, 56 and 58 and thereby control movement of inlet valves 44, exhaust valves 46 and fuel injector 50.

According to an aspect of the present invention, inlet air channel 32 of cylinder head 18 includes a single inlet opening 36 and two inlet valve seats 38 which are positioned in a parallel fluid flow configuration with each other such that combustion air or a fuel and air mixture is divided into two parallel fluid flows which terminate at inlet valve seats 38. To provide adequate combustion air into combustion chamber 30, it is desirable to provide two inlet valve seats 38, rather than a single inlet valve seat 38. By arranging inlet valve seats 38 in a parallel fluid flow configuration, rather than a series fluid flow configuration, the amount of combustion air which is transported to each inlet valve seat 38 is approximately the same. In the embodiment shown, inlet air channel 32 is configured to define main flow path 40 which is split into the two branching flow paths 42 which terminate at inlet valve seats 38. Inlet air channel 32 is configured such that branching flow paths 42 are positioned at an acute angle of between approximately 0 and 60 relative to main flow path 40. This ensures that the combustion air is approximately evenly split into the two branching flow paths 42. Configured as such, main flow path 40 and branching flow paths 42 have a generally Y-shape when viewed from the top of cylinder head 18.

INDUSTRIAL APPLICABILITY

During use, combustion air or a fuel and air mixture is transported through inlet opening 36 of inlet air channel 32. The combustion air flows through a main flow path 40 and splits into two branching flow paths 42 which terminate at inlet valve seats 38. The combustion air flows in a parallel fluid flow configuration through inlet air channel 32 to inlet valve seats 38. Axial movement of inlet valve 44 allows the combustion air to be transported into combustion chamber 30 within combustion cylinder 12. Fuel injector valve 50 is mechanically controlled to inject fuel into combustion chamber 30. After combustion occurs, exhaust valves 46 are moved out of exhaust valve seats 48 and the exhaust gasses are transported to the ambient environment through exhaust channel 34.

As described above, cylinder head 18 of the present invention includes an inlet air channel 32 with a single inlet opening 36 and two inlet valve seats 38 which are disposed in a parallel fluid flow configuration relative to main flow path 40 and branching flow paths 42. By configuring inlet air channel 32 with a parallel fluid flow configuration, rather than a series fluid flow configuration, adequate combustion air is supplied to each of inlet valve seats 38.

Moreover, by locating push rods 22, 24 and 26 in an area outside of inlet air channel 32, the flow of combustion air into each of inlet valve seats 38 is not impeded. Further, by positioning each of inlet valve seats 38 within a single inlet air channel 32 having a single inlet opening 36, the overall size of cylinder head 18 is reduced, thereby reducing the size, complexity and cost of internal combustion engine 10.

Push rods 22, 24 and 26 are each disposed within a cavity 60 in cylinder head 18. Push rods 22, 24 and 26 are thus disposed in an area within cylinder head 18 which is entirely outside of the area occupied by inlet air channel 32. By positioning push rods 22, 24 and 26 in an area outside of inlet air channel 32, the flow of combustion air through inlet air channel 32 is not impeded, which insures that adequate combustion air is supplied to combustion chamber 30.

Other aspects, objects and advantages of this invention can be obtained from a study of the drawings, the disclosure and the appended claims.

What is claimed is:

1. An internal combustion engine, comprising:

a housing having at least one combustion cylinder;

a cylinder head attached to said housing and covering at least one said combustion cylinder, said cylinder head including at least one inlet air channel, at least one exhaust channel and at least one cavity extending through said cylinder head, each said cavity being separated from each said at least one inlet air channel, each said inlet air channel and said exhaust channel associated with at least one respective said combustion cylinder, each said air inlet channel including a single inlet opening, a main flow path extending away from said inlet opening two branching flow paths extending from said main flow path and two inlet valve seats, said inlet valve seats positioned in a parallel fluid flow configuration with each other within said inlet air channel in separate branching flow paths; and a plurality of valves, each said valve disposed within a respective said inlet valve seat; and a plurality of push rods, each said push rod extending through said cavity; and connected to at least one said valve outside of each said air inlet channel.

2. The internal combustion engine of claim 1, wherein said cylinder head covers one said combustion cylinder and includes one said inlet air channel and one said exhaust channel.

3. The internal combustion engine of claim 1, further comprising a fuel injector seat, a fuel valve associated with said fuel injector seat and a push rod extending through said cavity and associated with said fuel valve, each said push rod being positioned in an area outside each of said inlet air channels.

4. The internal combustion engine of claim 1, wherein each said push rod is associated with one said inlet valve seat.

5. The internal combustion engine of claim 1, wherein said main flow path and said branching flow paths have a generally Y-shape.

6. The internal combustion engine of claim 1, wherein said two branching flow paths are each disposed at a generally acute angle relative to said main flow path.

7. The internal combustion engine of claim 6, wherein said two branching flow paths are each disposed at a generally acute angle of between 0 and 60° relative to said main flow path.

8. A method of supplying combustion air to an internal combustion engine, comprising the steps of:

providing a housing having at least one combustion cylinder;

covering at least one said combustion cylinder with a cylinder head, said cylinder head including at least one inlet air channel, at least one exhaust channel and at least one cavity separated from said at least one inlet air channel, each said cavity extending through said cylinder head, each said inlet air channel and said exhaust channel associated with at least one respective said combustion cylinder, each said air inlet channel including a single inlet opening a main flow path, two branching flow paths and two inlet valve seats, one said inlet valve seat at the end of each said branching flow path;

providing a valve associated with each said inlet valve seat;

connecting each said valve to a push rod outside each said air inlet channel;

extending each said push rod through said cylinder head in said cavity;

introducing the combustion air into said inlet air channel through said single inlet opening;

flowing the combustion air through said main flow path extending from said single inlet opening;

splitting the combustion air into said two branching flow paths which are disposed in a parallel fluid flow configuration relative to said main flow path, said two branching flow paths respectively terminating at said two inlet valve seats; and loading the combustion air into each said respective combustion cylinder through each said corresponding two inlet valve seats.

* * * * *

UNITED STATES PATENT AND TRADEMARK OFFICE

CERTIFICATE OF CORRECTION

PATENT NO. : 6,263,854 B1
DATED : July 24, 2001
INVENTOR(S) : Allyn P. Bock

It is certified that error appears in the above-identified patent and that said Letters Patent is hereby corrected as shown below:

Column 4,
Line 29, insert "," after "opening"

Column 5,
Line 7, insert "," after "opening"

Signed and Sealed this

Fifth Day of March, 2002

*Attest:*

*Attesting Officer*

JAMES E. ROGAN
*Director of the United States Patent and Trademark Office*